United States Patent [19]

Böjesgard et al.

[11] 4,269,151

[45] May 26, 1981

[54] COMBUSTION CHAMBER

[75] Inventors: Pehr Böjesgard, Finspong; Anders Kullendorff, Aby; Jan Wikner, Finspong, all of Sweden

[73] Assignee: Stal-Laval Turbin AB, Sweden

[21] Appl. No.: 10,355

[22] Filed: Feb. 8, 1979

[30] Foreign Application Priority Data

Feb. 13, 1978 [SE] Sweden ..... 7801617

[51] Int. Cl.[3] ..... B01J 8/18

[52] U.S. Cl. ..... 122/4 D

[58] Field of Search ..... 122/4 D; 110/245, 263

[56] References Cited

U.S. PATENT DOCUMENTS 2,853,455 9/1958 Campbell et al. ..... 122/4 D 3,915,657 10/1975 Staffin et al. ..... 110/245

4,009,121 2/1977 Luckenbach ..... 122/4 D

FOREIGN PATENT DOCUMENTS 1540378 2/1979 United Kingdom ..... 122/4 D

*Primary Examiner*—Anthony V. Ciarlante

[57] ABSTRACT

A pressurized combustion chamber assembly wherein a fluidized bed extends in a longitudinal direction through an elongated, cylindrically shaped outer casing. A multi-stage cleaning plant is positioned within the casing, whereby a plurality of cleaning devices are each connected in parallel to an outlet of the fluidized bed and a plurality of second stage cleaning devices are each connected to an outlet of one of the first stage cleaning devices, respectively. The combustion chamber assembly is formed from a plurality of separate prefabricated chamber modules separably attached to one another.

10 Claims, 2 Drawing Figures

COMBUSTION CHAMBER

BACKGROUND OF THE INVENTION

The present invention generally relates to fluidized bed combustion chambers of the type adaptable for use with relatively large gas turbine plants and the like. In particular, the present invention is directed to a unique combustion chamber which can be constructed from a plurality of prefabricated modules which are interconnected at the work station.

Conventional, large size combustion chambers have proven less than completely satisfactory; thus, such structures are generally bulky and tend to occupy excessive amounts of space in relation to the output of hot combustion gases generated therein. A further problem confronting known combustion chambers is the difficulty in transporting the large and bulky chambers from the manufacturing plant to their respective work stations. Finally, the casings of known combustion chambers tend to become excessively stressed due to a combination of the compressed gases within the casing, the weight of the fluidized bed against the casing and any thermal stresses which arise during operation of the combustion chamber. As a result, the outer casing of such combustion chambers must be formed of a relatively greater width than would be otherwise necessary.

As will be discussed in detail hereafter, the present invention solves the aforestated problems confronting known combustion chambers, while at the same time providing an efficiently designed, fluidized bed combustion chamber capable of supplying an output level of hot and clean combustion gases sufficient for powering relatively large gas turbines and the like.

OBJECTS OF THE PRESENT INVENTION

An object of the present invention is to provide a combustion chamber assembly wherein an elongated fluidized bed is enclosed within a substantially cylindrically-shaped outer casing.

A further object of the present invention is to provide a combustion chamber wherein a multi-stage cleaning plant is positioned within the outer casing adjacent the fluidized bed, to separate debris and the like from hot combustion gases which exit from the fluidized bed.

Another object of the present invention is to provide a combustion chamber which is constructed of a plurality of prefabricated modules which are fixedly attached to one another only upon arrival at the work station.

An object of the present invention is to provide a combustion chamber wherein the fluidized bed is entirely supported on a base plate, to avoid adding any stress load directly against the outer casing walls.

These and other objects of the present invention will become apparent from a reading of the following specification and claims, together with the accompanying drawings, wherein similar elements are referred to and are indicated by similar reference numerals.

BRIEF DESCRIPTION OF THE DRAWINGS

The present invention can be best understood with reference to the accompanying drawings, wherein.

DETAILED DESCRIPTION OF THE PREFERRED EMBODIMENT

Figure 1:
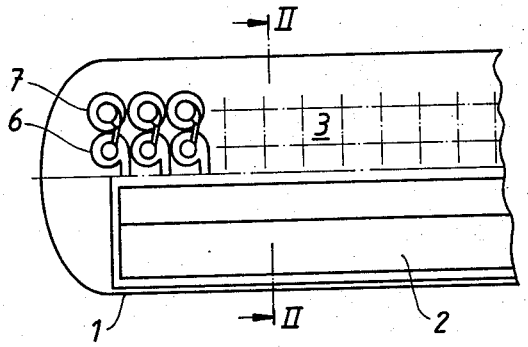
FIG. 1 shows a top view of a portion of a fluidized bed combustion chamber formed in accordance with a preferred embodiment of the present invention.

Referring to FIG. 1, a top view of a portion of a combustion chamber formed according to the present invention is shown. The remaining, not shown, portion of the combustion chamber is substantially similar in structure to the portion shown, and has been left out to simplify explanation of the present invention. A substantially cylindrically-shaped outer casing is designated at 1, with outer casing 1 enclosing an elongated fluidized bed combustion chamber 2, which is substantially conical in cross-section as clearly shown in FIG. 2. A multi-stage gas cleaning assembly 3 is also positioned within casing 1 adjacent to fluidized bed 2.

Figure 2:
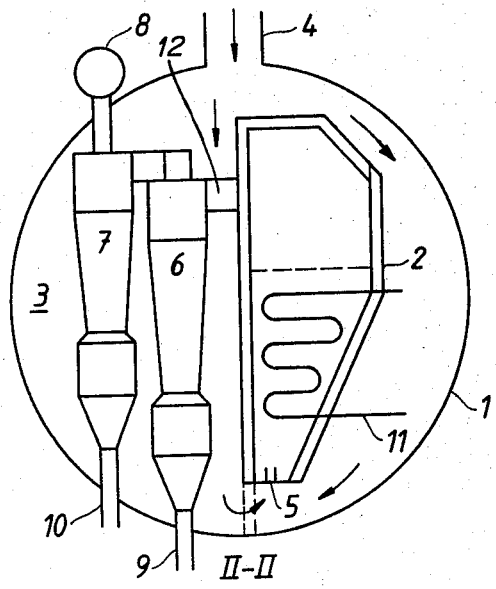
FIG. 2 shows a cross-sectional view taken along the line II—II of FIG. 1 and enlarged in scale for purposes of explanation.

A compressed gas, such as air, is introduced into casing 1 via an inlet 4 formed through a vertically upper portion of casing 1. As indicated by the arrows in FIG. 2, portions of the compressed air flow about either side of fluidized bed 2 and eventually reach a plurality of nozzles 5 formed through lowermost end surfaces of fluidized bed 2. While only a single nozzle 5 is shown in FIG. 2, it is to be understood that a plurality of similarly-shaped nozzles 5 are spaced along, and extend through the lowermost surface of elongated fluidized bed 2. The compressed air enters fluidized bed 2 via nozzles 5 and reacts in a conventional manner with a solid, liquid or gaseous fuel which has also been introduced into fluidized bed 2 via a conventional connection assembly, which in itself forms no part of the present invention.

In a preferred embodiment of the present invention, fluidized bed 2 is closed on substantially all sides, with the compressed air entering through nozzles 5 and the hot combustion gases generated in the chamber exiting through a plurality of spaced outlet conduits 12 each of which is attached to the multi-stage cleaning assembly 3.

The multi-stage cleaning assembly 3 includes a plurality of separate cyclone filters 6, each of which is attached to a separate outlet conduit 12 extending from an upper end portion of fluidized bed 2. As a result of separately connecting each cyclone 6 to fluidized bed 2, the cyclone filters 6 act in parallel, with each cyclone simultaneously receiving and cleaning a portion of the hot combustion gases emitted from fluidized bed 2. A further plurality of separate cyclone filters 7 may be positioned adjacent to cyclones 6, with each cyclone filter 7 having an inlet conduit attached to an outlet of a respective adjacent cyclone 6. In this manner, each pair of cyclone filters 6 and 7 act in series to separate debris, ash and the like from the hot combustion gases flowing therethrough. It is within the scope of the present invention to construct cyclones 6 to filter only relatively coarse debris from the combustion gases, with attached cyclones 7 functioning to separate relatively fine debris from the combustion gases during a second cleaning stage.

In an alternative embodiment, the cyclones 7 are replaced by a plurality of fiber filter boxes which are attached to each of the cyclones 6, respectively. Whether cyclones 7 or fiber filter boxes are employed, an outlet extends from each of the second stage cleaning devices to a common exhaust conduit 8, which can be conveniently located either outside casing 1, as shown in FIG. 2, or inside the casing. Conduit 8 provides a fluid passageway for carrying the hot combustion gases from the combustion chamber assembly to an inlet of a large gas turbine assembly and the like. A discharge conduit 9 is attached to and extends vertically beneath each of the cyclones 6, while a similar discharge conduit is attached to and extends vertically beneath each of the cyclones 7, respectively. Debris which has been separated from the combustion gases is transported through either discharge conduit 9 or 10 to a treatment station which, in itself, makes up no part of the present invention.

A tubular passageway 11 extends through fluidized bed 2, with the passageway capable of transporting either a boiling or cooling fluid therethrough as desired. For example, the compressed air can be directed through tubular passageway 11 prior to entering the combustion chamber via inlet 4; which effectively preheats the compressed air prior to entry into the combustion chamber. Alternatively, clean air passing through a separate closed circuit can also be heated by passage through tubular passageway 11. In a further example, tubes 11 may constitute boiler or superheater tubes for a boiler plant in a combined gas-station-turbine plant. The tubes 11 extend substantially transversely throughout the elongated fluidized bed 2 to ensure effective heat transfer with gases located with fluidized bed 2, as well as to provide a stable and secure structure.

The present invention is uniquely designed to allow longitudinal sections of the combustion chamber to be separately prefabricated and attached to one another only upon arrival at the final work station. In this manner, any number of prefabricated sections or modules can be separately transported and then combined to provide combustion chambers of varying sizes as required. While only an end portion of the chamber is shown in FIG. 1, it is to be understood that each prefabricated module is defined by a pair of spaced planes extending perpendicularly through the longitudinal section of the combustion chamber shown in FIG. 1. A further advantage of employing prefabricated modules is the ability to construct combustion chambers having diameters of up to 10 meters or more which are capable of handling a compressed gas of 10 to 15 bar, thereby allowing the combustion chamber to provide a sufficient amount of hot combustion gases for driving large gas turbines and the like on low grade conventional fuels.

It is also within the scope of the present invention to mount fluidized bed 2 and cleaning assembly 3 on a support member having a rigid portion abutting a middle portion of fluidized bed 2 and flexible portions abutting end portions of the fluidized bed 2, in order to substantially fix the position of bed 2 relative to casing 1, while allowing fluidized bed 2 to freely expand in respond to thermal stresses which may arise. Finally, the supports for the fluidized bed 2 may be positioned directly on top of the corresponding base plate which provides support for the outer casing. This arrangement ensures that the actual weight of the fluidized bed 2 is supported entirely by the base plate, without providing any adverse load against the walls of outer casing 1.

The present invention is not limited to the above-described embodiments, but is to be limited only by the scope of the following claims.

What is claimed is:

1. A pressurized combustion chamber assembly capable of providing heated combustion gases for use in gas turbine assemblies and the like, and comprising:

an elongated, hollow outer casing assembly including an inlet aperture extending through a wall thereof to allow a coampressed gas, such as air, to enter said casing;

an elongated, fluidized bed combustion chamber positioned within said outer casing, said fluidized bed combustion chamber having a wall portion confronting an inner surface of said outer casing and defining a fluid passageway sufficient to allow said compressed gas to enter said inlet aperture and flow between said fluidized bed combustion chamber and said outer casing, thereby receiving and transferring excessive heat away from said wall portion of said fluidized bed combustion chamber;

inlet means extending through further wall portions of said fluidized bed combustion chamber for allowing said compressed gas to enter said fluidized bed combustion chamber;

outlet means extending through wall portions of said fluidized bed for allowing hot combustion gases to exit from said fluidized bed combustion chamber; and cleaning means positioned within said outer casing separate from said fluidized bed combustion chamber and in fluid connection with said outlet means for receiving hot combustion gases from said combustion chamber and separating debris from said hot combustion gases while flowing therethrough.

2. A combustion chamber according to claim 1, wherein said hollow outer casing is substantially cylindrical in shape and extends longitudinally within a substantially horizontal plane.

3. A combustion chamber according to claim 1, wherein said fluidized bed combustion chamber extends substantially adjacent to one side of said outer casing; and said cleaning means is positioned substantially adjacent an opposite side of said outer casing.

4. A combustion chamber according to claim 1, wherein a tubular heat exchanger assembly extends through said fluidized bed, with said tubular assembly extending substantially along horizontal planes passing through said fluidized bed combustion chamber.

5. A combustion chamber according to claim 1, wherein said inlet means comprises a plurality of spaced apertures each extending through a wall portion of said fluidized bed.

6. A combustion chamber according to claim 1, wherein said outlet means comprises a plurality of spaced apertures extending through an upper wall portion of said fluidized bed remotely positioned from said support assembly.

7. A combustion chamber according to claim 5, wherein said plurality of spaced inlet apertures each extends through a bottom wall of said fluidized bed remotely positioned from said inlet formed in said casing.

8. A combustion chamber according to claim 1, wherein said cleaning means comprises a first cleaning stage including a plurality of separate cyclone filter devices, each having an inlet conduit in fluid connection with said outlet means, whereby each cyclone filter device acts in parallel to the remaining filter devices.

9. A combustion chamber according to claim 8, wherein said cleaning means further comprises a second cleaning stage including a plurality of further cyclone filter devices, each further cyclone device having an inlet in fluid connection with an outlet extending from a respective first stage cyclone filter device, whereby each pair of attached cyclones functions in series to remove debris and the like from the hot combustion gases flowing therethrough.

10. A combustion chamber according to claim 8, wherein said cleaning means further comprises a second cleaning stage including a plurality of fiber filter boxes, each filter box having an inlet in fluid communication with an outlet extending from a respective cyclone filter device to provide a plurality of pairs of cleaning devices acting in series to remove debris and the like from the hot combustion gases flowing therethrough.

* * * * *

UNITED STATES PATENT AND TRADEMARK OFFICE

CERTIFICATE OF CORRECTION

PATENT NO. : 4,269,151

DATED : May 26, 1981

INVENTOR(S) : Pehr Borjesgard et al.

It is certified that error appears in the above—identified patent and that said Letters Patent is hereby corrected as shown below:

On The Title Page, first inventor's name should read -- Pehr Borjesgard --.

Signed and Sealed this

*Eighteenth* Day of *August 1981*

[SEAL]

*Attest:*

GERALD J. MOSSINGHOFF

*Attesting Officer*

*Commissioner of Patents and Trademarks*